US005307769A

United States Patent [19]

Meagher et al.

[11] Patent Number: 5,307,769

[45] Date of Patent: May 3, 1994

[54] LOW MASS ROLLER VALVE LIFTER ASSEMBLY

[75] Inventors: Richard P. Meagher, Fairport; Rick C. Wirth, Henrietta, both of N.Y.; Thomas Braun, Walker, Mich.

[73] Assignee: General Motors Corporation, Detroit, Mich.

[21] Appl. No.: 72,372

[22] Filed: Jun. 7, 1993

[51] Int. Cl.[5] ..... F01L 1/14

[52] U.S. Cl. ..... 123/90.5; 74/569

[58] Field of Search ..... 123/90.48, 90.5; 74/569

[56] References Cited

U.S. PATENT DOCUMENTS

| | | | |
|---|---|---|---|
| Re. 25,974 | 3/1966 | Dadd | 123/90 |
| 1,345,942 | 7/1920 | McCain | 29/888.43 |
| 1,399,839 | 12/1921 | Alborn | 123/90.5 |
| 1,464,082 | 8/1923 | Leo | 123/90.61 |
| 1,566,923 | 12/1925 | Roberts | 384/261 |
| 1,682,821 | 9/1928 | Woolson | 123/90.33 |
| 1,802,330 | 4/1931 | Boland | 123/90.5 |
| 1,840,633 | 1/1932 | Morehouse | 184/6.9 |
| 3,668,945 | 6/1972 | Hofmann | 123/90.5 |
| 4,089,234 | 5/1978 | Henson et al. | 123/90.5 |
| 4,173,954 | 11/1979 | Speckhart | 123/90.5 |
| 4,231,267 | 11/1980 | Van Slooten | 74/569 |
| 5,022,356 | 6/1991 | Morel, Jr. et al. | 123/90.5 |

*Primary Examiner*—E. Rollins Cross
*Assistant Examiner*—Weilun Lo
*Attorney, Agent, or Firm*—Charles K. Veenstra

[57] ABSTRACT

An assembly of a low mass roller valve lifter having a body diameter smaller than the diametral extent of the associated roller and a sleeve sized to receive protruding portions of the roller. The sleeve has a transverse slot that guides flatted ends of the roller shaft to restrain rotation of the lifter body and of the roller shaft. Various sleeve retainers are disclosed and oil supply means are provided suitable for new or reworked engines.

25 Claims, 4 Drawing Sheets

LOW MASS ROLLER VALVE LIFTER ASSEMBLY

TECHNICAL FIELD

This invention relates to roller valve lifters for engines and, more particularly, to small diameter low mass roller lifters including hydraulic lifters for valve actuation and lash take up.

BACKGROUND

U.S. Pat. No. 1,345,942 issued Jul. 6, 1920 discloses a lightweight roller valve lifter having a cylindrical hollow body slotted to receive a roller rotatable on a shaft carried in legs separated by the roller slot. The roller diameter is larger than the body and is guided by a surrounding slotted sleeve acting as a tappet guide that is fixed to the engine crankcase and prevents cocking of the roller relative to its actuating cam. The shaft is retained in openings of the legs by the tappet guide.

U.S. Pat. No. 4,231,267 issued Nov. 4, 1980 discloses a hydraulic roller valve lifter having a roller/shaft assembly bottom loaded into slots in spaced struts. The shaft has flats that engage slots in the struts that retain the shaft against lateral or rotational motion, bent tangs retaining the shaft in the slots. The lifter guide bore is formed in the engine block and is larger than the roller diameter. Cocking of the roller is prevented by flats (not described) on the lifter body which are commonly used in current lifters.

It is desired to provide a hydraulic roller valve lifter with a lighter body of smaller diameter than the roller which retains its original size. Installation from the roller end of the lifter must be retained and means for avoiding cocking of the roller and rotation of the roller shaft must be provided.

SUMMARY OF THE INVENTION

The present invention meets these requirements by providing a downsized hydraulic lifter body with inner hydraulic elements of conventional configuration but smaller size than current commercial units. Support means are provided for a roller of normal size which has a larger diameter or diametral extent than the body. To provide for installation in an engine from the roller end of the lifter, the body is reciprocably received in a separate sleeve and is held in assembly therewith by retaining means such as a wire retainer. Lateral slots in the sleeve receive a slotted retainer for holding the sleeve against rotation in a lifter gallery bore or bushing. The sleeve is longitudinally slotted to clear extending portions of the roller and also has a transverse longitudinal slot cooperating with extending flatted ends or tangs of the shaft to both guide the roller against cocking and prevent pin rotation. Retaining pins may be used to maintain the shaft centered and avoid its engaging the bore of the lifter gallery or oil directing bushing if provided.

These and other features and advantages of the invention will be more fully understood from the following description of certain specific embodiments of the invention taken together with the accompanying drawings.

BRIEF DRAWING DESCRIPTION

DETAILED DESCRIPTION

Figure 2:
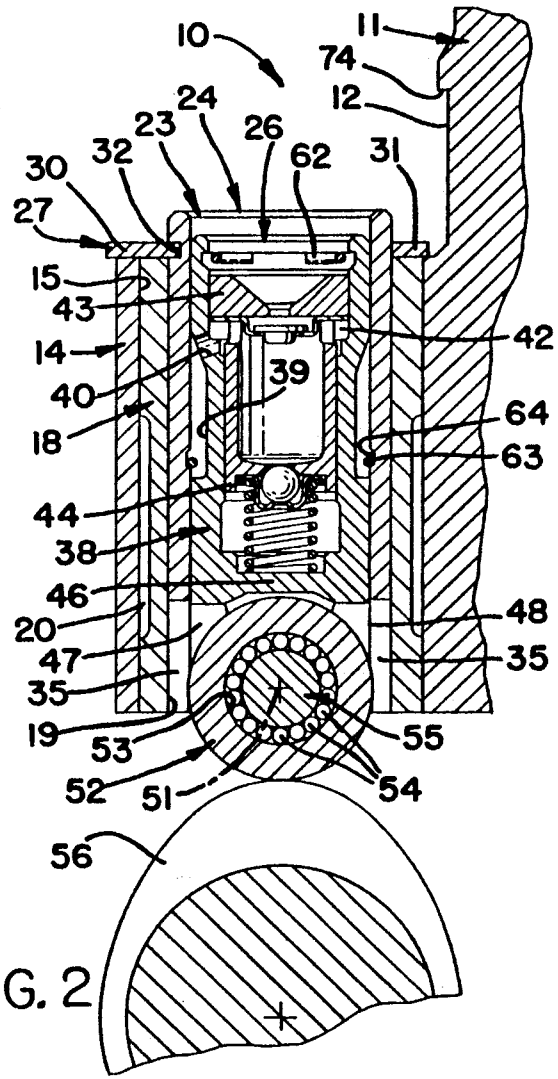
FIG. 2 is a transverse cross-sectional view from the plane of the line 2—2 of FIG. 1.
Figure 1:
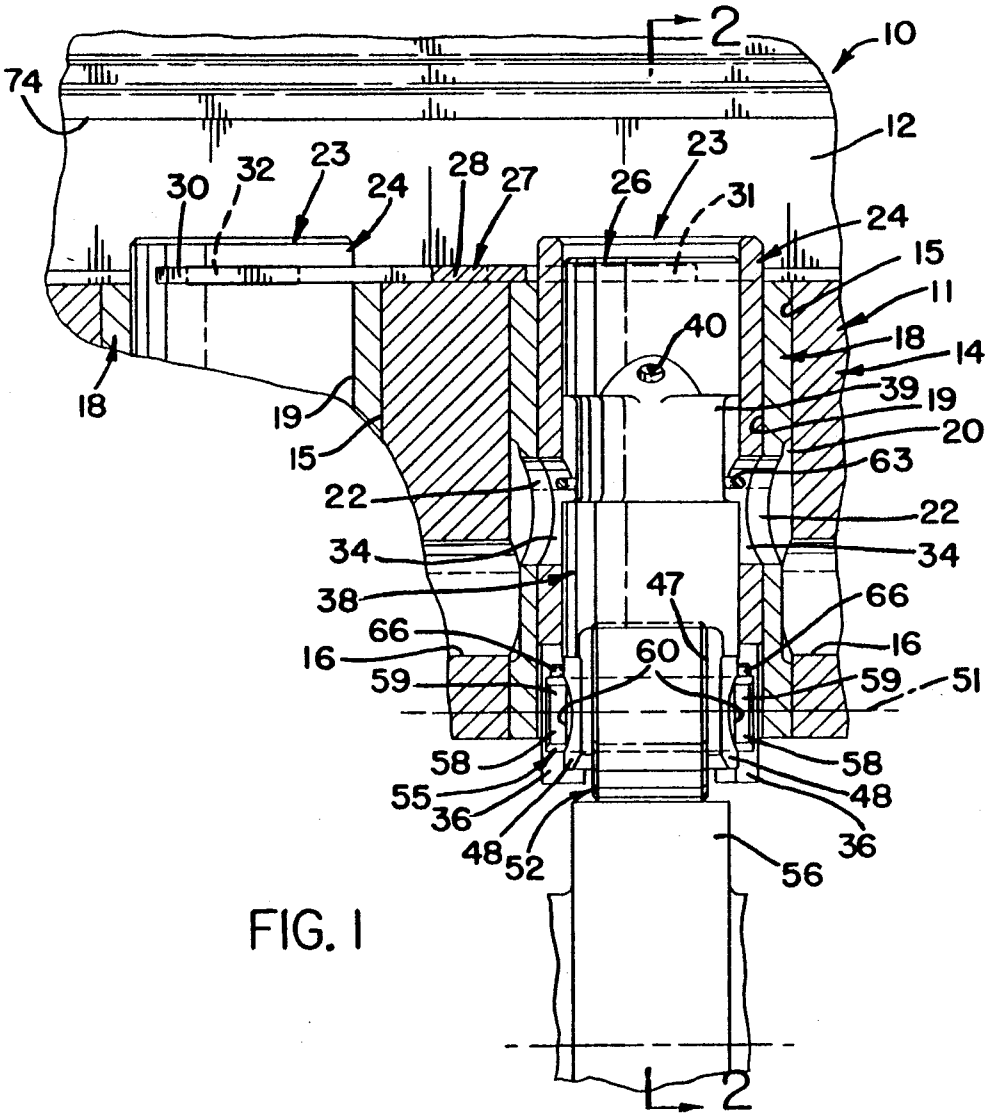
FIG. 1 is a longitudinal cross-sectional view of an engine block lifter gallery including a roller valve lifter according to the invention.
Figure 3:
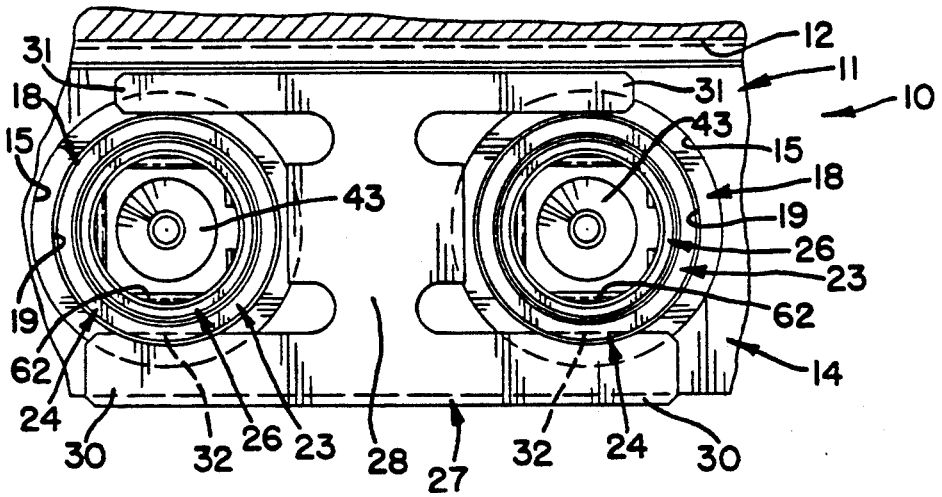
FIG. 3 is a top view of portions of the engine block lifter gallery shown in FIG. 1.
Figure 4:
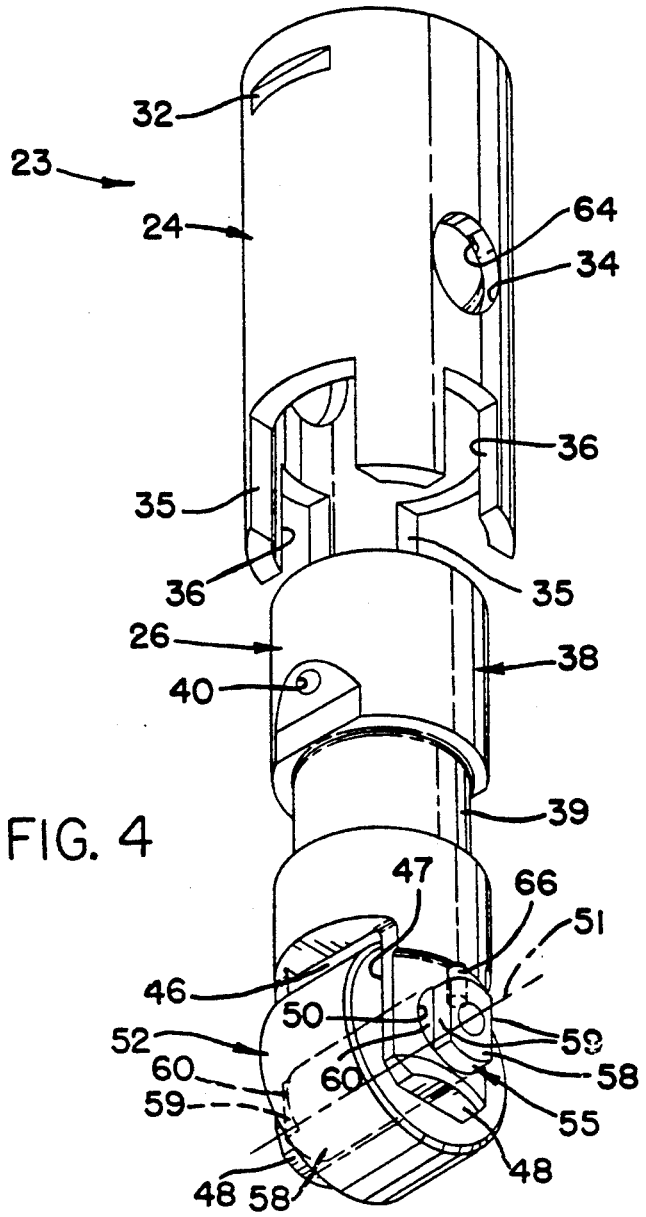
FIG. 4 is a pictorial view partially exploded of the roller lifter assembly of FIGS. 1-3.

Referring now to the drawings in detail, numeral 10 generally indicates an internal combustion engine 10 having a cylinder block 11 including an inner side wall 12 and a lifter gallery 14 supported thereon. The lifter gallery 14 includes a plurality of bores 15, each of which is intersected by an oil gallery 16 for delivering pressure oil to the bores 15.

If desired, the bores 15 may directly receive valve lifters for reciprocating motion therein. However, in the embodiment of FIGS. 1-4, the bores 15 are provided with sleeve-like bushings 18 that are pressed or otherwise retained in the bores 15 and have cylindrical inner surfaces 19 which act as lifter receiving bores for the cylinder block 11. Externally each bushing 18 has an annular groove 20 that connects the oil gallery 16 with oil holes 22 through the bushing at a level higher than the gallery 16.

Within each bushing is removably received a roller valve lifter assembly 23 comprising a cylindrical sleeve 24 reciprocably receiving a hydraulic roller lifter 26. Each sleeve together with the sleeve of an adjacent lifter assembly 23 is positioned in its bushing 18 by a self locating retainer 27. The retainer is a flat member having a central support 28 with oppositely extending pairs of arms 30, 31 which engage opposite sides of the sleeves and whereof at least one arm 30 of each pair bears on a flat 32 formed by a lateral slot on at least one side of each sleeve near its upper end. The retainer 27 lies along an upper surface of the lifter gallery 14 and holds the slotted portion of each sleeve in alignment therewith. The retainer is held in place by springs or other means, not shown, engaging the central support 28 to hold it down against the lifter gallery.

Each sleeve 24 has a pair of lateral holes 34 aligned with the oil holes 22 of the bushing 18 to carry oil from the gallery to the roller lifter 26. The sleeve further has a pair of perpendicular cross slots open to its lower end, a relatively wide roller slot 35 and a narrower non-rotation slot 36.

Each roller lifter 26 comprises a generally cylindrical lifter body 38 slidable with close clearance in the sleeve 24. A central annular groove 39 receives oil delivered through the lateral holes 34 of the sleeve and distributes it through a passage 40 to the hollow interior 42 of the lifter body 38. Within the body hollow interior are downsized hydraulic elements of conventional configuration including a push rod seat 43 at the driving (upper) end and hydraulic actuating and lash adjusting means 44 located between the ends.

At its driven (lower) end, the body 38 has a solid lower wall 46 below which is a transverse slot 47 separating spaced legs 48, the legs 48 having through holes 50 aligned on a transverse axis 51 normal to the transverse slot 47. A cam engaging roller 52 is received in the slot 47 and has an axial bore 53 that is journaled by needle bearings 54 on a shaft 55 for rotation on the axis 51. The outer diameter of the roller 52 is larger than the outer diameter of the associated body 38 so that it protrudes into the roller slot 35 of the sleeve 24. However, a smaller roller having a maximum dimension parallel to a diameter of the body that is greater than the body diameter would also protrude into the slot 35. The roller is engaged by a cam 56 of a camshaft (not further shown) for actuating the lifter in the sleeve 24 in known manner.

The roller shaft 55 extends through and is retained in the holes 50 of legs 48. The shaft has ends 58 that extend beyond the legs 48 into the non-rotation slot 36 of the associated sleeve 24. The ends 58 are cut away to form flats 59 that engage the edges of the slot 36 and shoulders 60 that bear on the inner surface of the sleeve adjacent the slot to restrain the shaft against rotation and lateral motion.

The lifter assembly is provided with several retaining devices to maintain the elements together during shipping and handling. These include a conventional plunger retainer 62 comprising a wire spring that snaps into a groove in the hollow open end of the lifter body to retain the push rod seat 43 and the hydraulic actuating and lash adjusting means 44 within the body when not in an engine. Another is a lifter and sleeve assembly retainer 63, being a wire spring that is placed in the annular groove 39 around the lifter body 38 and, upon insertion of the body 38 into the sleeve 24, snaps into an internal groove 64 provided within the sleeve to retain the body within the sleeve.

If desired, small pins 66 may be positioned in holes, not shown, in the ends 58 of the shaft 55 between the flats to prevent the shaft from moving or sliding out of the body holes 50 during handling. Also, these pins could be used to prevent lateral motion of the shaft after installation in an engine so that the shoulders 60 are prevented from engaging the inner surface of the sleeve 24 and the chance of wear or damage to the sleeve surface is thereby reduced.

In use, a valve lifter body 38 is assembled with the hydraulic elements 44 and push rod seat 43 in a conventional manner. The roller with the needle bearings 54 inserted is placed in the slot 47 and the shaft 55 is inserted. The optional pins 66 may then be installed to prevent axial movement of the shaft.

The assembly retainer 63 is then installed around the annular groove 39 and the assembled roller lifter 26 is inserted into the sleeve 24 from the lower slotted end (since it cannot be inserted from the other end). The roller is guided into the roller slot 35 and the ends 58 of the shaft 55 are guided into the non-rotation slots 36 with the flats 59 engaging the slot's edges. The retainer 63 is snapped into the internal groove 64 to maintain the parts in the assembly 23.

For assembly in an engine, two roller lifter assemblies 23 are assembled into the open ends of a lifter retainer 27 with the arms 30 against the flats 32. The two lifters are then inserted from the top, roller end first, in the lifter bores formed by the bushings 18 in adjacent bores 15 of the engine lifter gallery 14. The retainers are then fixed against the lifter gallery by springs or other means engaging the central support portions 28 to maintain the sleeves 24 in fixed positions.

In operation, rotation of the cams 56 against the rollers 52 reciprocates the roller valve lifters 26 in their sleeves 24 to actuate the push rods and other engine valve gear, not shown. The shafts 55 are prevented from rotating in the holes 50 by sliding engagement of the flats 59 against the edges of the non-rotation slots 36 in the sleeves 24. The sleeves are rotationally fixed by the engagement of their flats 32 by the retainer arms 30 and the sleeves prevent cocking of the roller out of alignment with the cam through engagement of the non-rotation slots 36 with the flats 59 of the shafts 55.

The described arrangement provides, through the use of the sleeve 24, means by which a low mass lifter having a body 38 smaller in diameter than its associated roller 52 may still be installed roller end first into the lifter gallery of an engine from the accessible top side of the engine block. In addition, the sleeve provides means for preventing rotation of the lifter and the roller shaft, simplifying the construction of the complete lifter assembly. It should be recognized that these advantages could be applied to solid tappets or mechanical lifters of the roller type as well as to the hydraulic roller lifter arrangement described.

The bushings 18 are operative in the arrangement of FIGS. 1–4 for use in an engine block previously designed for the application of flat ended non-roller lifters where the oil gallery 16 is located at a low level for alignment with such lifters. The bushings raise the entry level of oil into the roller lifters 26 sufficiently above the top of the slots 36 in the sleeve to avoid the loss of oil pressure that would occur if the oil gallery 16 were to feed directly the outer side of the sleeve 24. However, bushings might be also used for other reasons, such as compatibility of materials, if desired.

Figure 5:
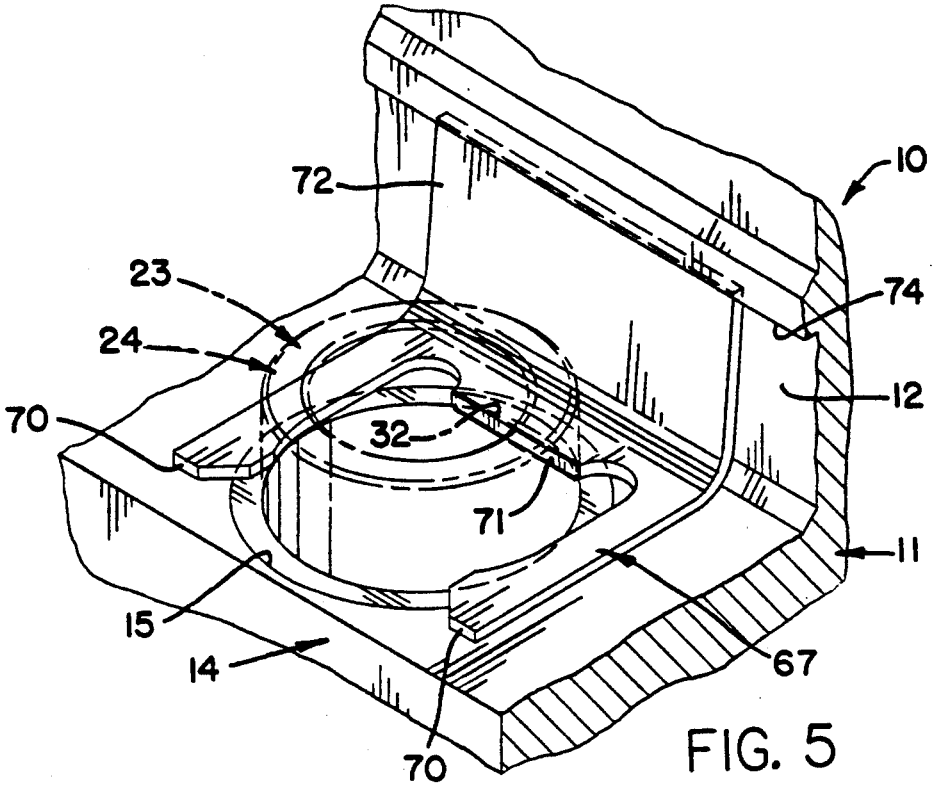
FIG. 5 is a pictorial view of an alternative embodiment of lifter retainer.

FIG. 5 illustrates an alternative retainer 67 for holding a lifter assembly sleeve 24 fixed in an engine block 11. The retainer 67 has arms 70 that grip the sleeve and hold it with the flat 32 engaging a central tang 71 connected with the arms 70 and an upstanding tab 72. The tab 72 snaps into a recess 74 (See FIG. 1) machined into the wall 12 of the engine block 11 adjacent to the lifter gallery 14. Optionally, the retainer could be modified to hold two or more sleeves 24 of lifter assemblies snapped into laterally extending arms 70 instead of only one sleeve 24 as shown.

Figure 6:
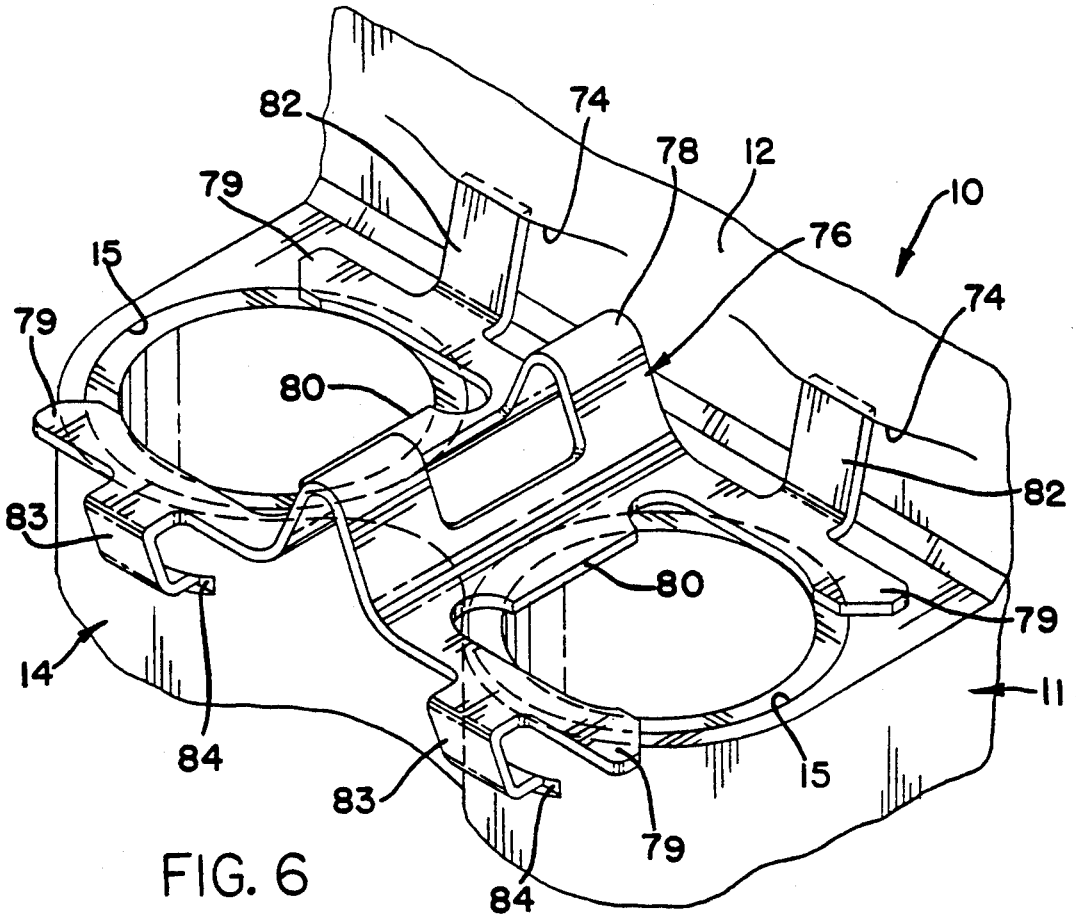
FIG. 6 is a pictorial view of another embodiment of lifter retainer.

FIG. 6 illustrates another alternative retainer arrangement wherein a metal or composite body 76 has a flexible raised center 78 connecting with oppositely extending pairs of arms 79 joined by central portions having tangs 80. The arms and tangs are adapted to hold a pair of lifter sleeves 24 in the same manner as those of the FIG. 5 embodiment. Upstanding tabs 82 engage block recesses 74 in the manner previously described. Additional downwardly extending jaws 83 snap into slots 84 cut into the outer wall of the lifter gallery 14. If desired, the design could be modified to eliminate the jaws or the tangs or both. Also, the retainer body 76 could be divided to receive only a single longitudinally installed sleeve 24 of a lifter assembly 23.

Figure 8:
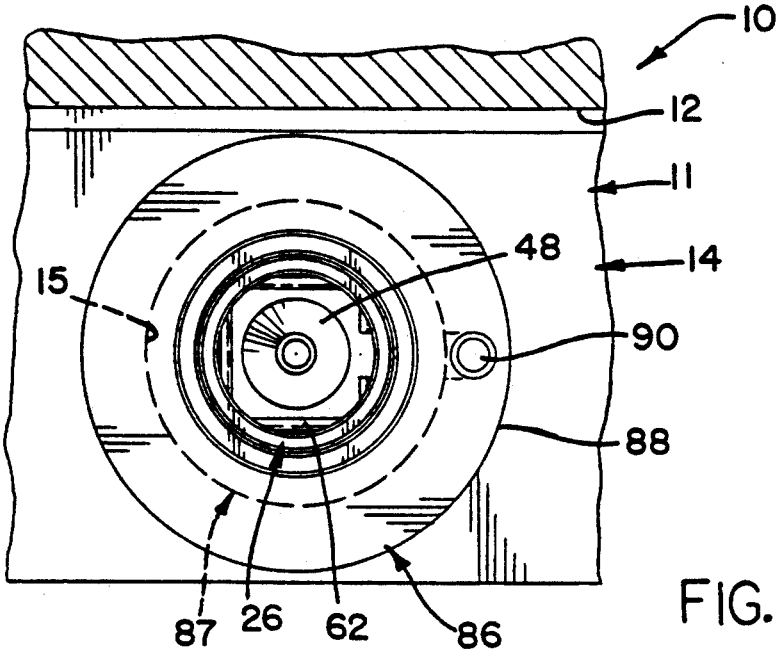
FIG. 8 is a top view of the assembly of FIG. 7.
Figure 7:
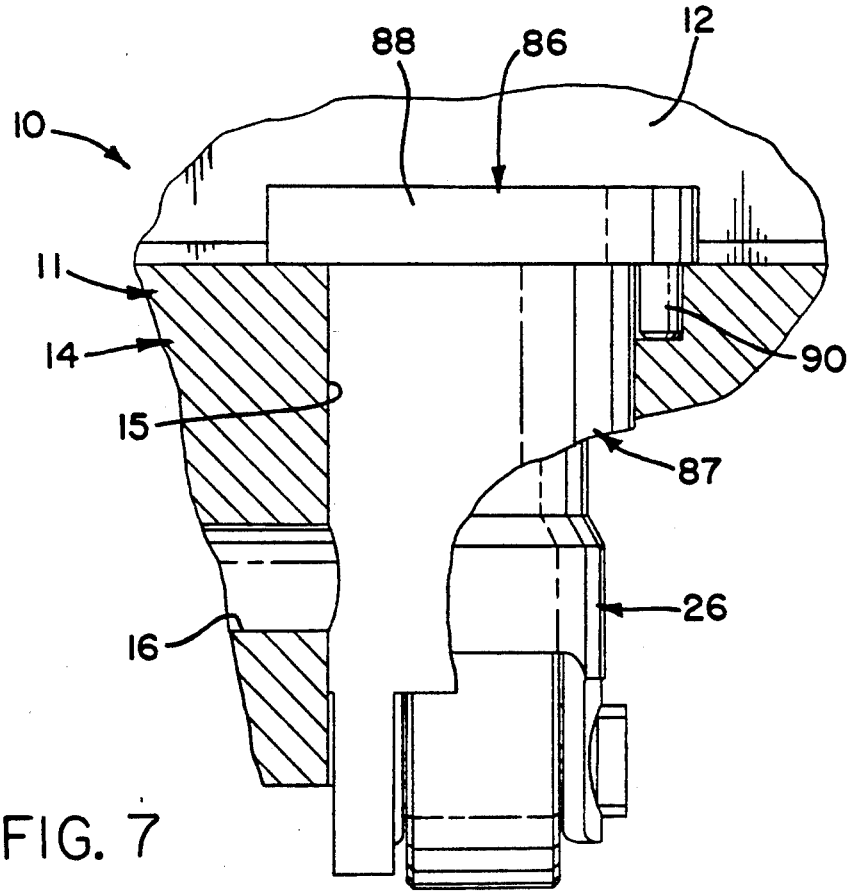
FIG. 7 is a side view partially broken away of an alternative embodiment of roller lifter assembly according to the invention.

FIGS. 7 and 8 illustrate an alternative embodiment of lifter assembly 86 in which the roller lifter 26 is unchanged but the sleeve 87 is provided with a flange 88 at its upper end. The flange is designed to ride on the top of an associated lifter gallery 14. A pin 90 fixes the sleeve against rotation in the lifter gallery, thus preventing cocking of the roller on the cam. Suitable means, not shown may be provided to hold the flange against the lifter gallery and maintain the sleeve in the lifter bore.

While the invention has been described by reference to certain preferred embodiments, it should be understood that numerous changes could be made within the spirit and scope of the inventive concepts described. Accordingly it is intended that the invention not be limited to the disclosed embodiments, but that it have the full scope permitted by the language of the following claims.

What is claimed is:

1. A roller valve lifter assembly comprising a roller valve lifter and a sleeve reciprocably receiving the valve lifter, the valve lifter including a cylindrical body having first and second ends, said first end being slotted to form a pair of spaced legs having a pair of openings in said legs aligned on a transverse axis, a roller having a central bore received between said legs with the bore aligned on the axis, and a shaft received in the openings and extending through the bore to rotatably journal and support the roller between the legs, the shaft having opposite ends extending beyond the cylindrical body, and the sleeve having a transverse slot open at one longitudinal end and receiving the shaft ends for reciprocation therein, the shaft ends being engageable with edges of the slot to prevent rotation of the lifter in the sleeve, wherein the cylindrical body has an outer diameter smaller than a maximum dimension of the roller parallel with a body diameter but the sleeve has an outer diameter larger than said maximum dimension of the roller, the sleeve being slotted in a direction normal to the shaft axis to receive protruding portions of the roller.

2. A roller valve lifter assembly as in claim 1 wherein the opposite ends of the shaft form tangs having flats on lateral sides thereof, the flats engaging the edges of the slot to prevent rotation of the shaft in the openings.

3. A roller valve lifter assembly as in claim 2 wherein the shaft further includes shoulders adjacent the flats and operative, unless restrained, to bear on an inner surface of the sleeve to restrain the shaft against lateral motion.

4. A roller valve lifter as assembly in claim 3 and further including means on the shaft and engaging the legs to restrain lateral motion of the shaft and prevent engagement of the shoulders with the sleeve inner surface.

5. A roller valve lifter assembly as in claim 1 and further including sleeve retaining means on the sleeve for cooperation with external means to prevent rotation of the sleeve relative to a supporting body.

6. A roller valve lifter assembly as in claim 5 wherein said sleeve retaining means comprises at least one exterior flat on the sleeve and engageable by said external means.

7. A roller valve lifter assembly as in claim 6 wherein said at least one flat is formed by a lateral slot.

8. A roller valve lifter assembly as in claim 1 and further comprising assembly retainer means acting between the sleeve and the body to limit their relative motion and maintain these elements in assembly during shipping and handling.

9. A roller valve lifter assembly as in claim 8 wherein the assembly retainer means comprise a wire spring received in an external groove of the lifter body and retained in an internal groove provided in the sleeve inner surface.

10. A roller valve lifter assembly as in claim 1 wherein the lifter body includes an external oil supply groove between the ends, the sleeve having at least one opening registering with the groove for supplying oil thereto.

11. A roller valve lifter assembly as in claim 10 wherein the lifter body includes hydraulic lash adjusting means receiving oil from the groove.

12. A roller valve lifter assembly as in claim 5 in combination with a supporting body including a lifter gallery having at least one bore and an upper surface, the sleeve being received in the bore with an opposite end from the transverse slot adjacent the gallery upper surface, and a sleeve retainer acting between the supporting body and the sleeve retaining means to locate the sleeve longitudinally and rotationally in a predetermined fixed position in the bore.

13. A roller valve lifter assembly as in claim 7 in combination with an engine including a lifter gallery having at least one bore and an upper surface, the sleeve being received in the bore with an opposite end from the transverse slot extending slightly above the gallery upper surface and the lateral slot being spaced near the opposite end and aligned with the gallery upper surface, and a sleeve retainer engaging the lateral slot and the engine to locate the sleeve longitudinally and rotationally in a predetermined fixed position in the bore.

14. The invention as in claim 13 wherein the retainer includes spaced arms extending on opposite sides of the sleeve.

15. The invention as in claim 14 wherein one of the arms engages the lateral slot.

16. The invention as in claim 14 wherein the arms extend longitudinally of the engine.

17. The invention as in claim 14 wherein the arms extend laterally of the engine.

18. The invention as in claim 14 wherein the engine includes a wall rising adjacent the lifter gallery upper surface and the retainer engages said wall.

19. The invention as in claim 14 the lifter gallery includes a pair of adjacent lifter bores and the retainer has oppositely extending pairs of arms engageable with a pair of lifter assembly sleeves for installation together in said adjacent bores.

20. The invention as in claim 18 wherein the lifter gallery includes at least one outer slot disposed below the upper surface and the retainer also engages the outer slot.

21. The invention as in claim 12 wherein the sleeve retaining means is a flange on said opposite end and lying against the upper end of the lifter gallery.

22. The invention as in claim 21 wherein the retainer comprises a pin.

23. The invention as in claim 10 in combination with an engine including a lifter gallery having at least one bore and an upper surface, the sleeve being received in the bore, and passage means opening to the bore and registering with the sleeve opening for delivering oil thereto.

24. The invention as in claim 23 wherein the gallery bore is defined by a bushing fixed in the lifter gallery and the passage means includes an opening in the bushing and communicating externally with an engine oil gallery.

25. The invention as in claim 24 wherein the oil gallery is offset below the bushing opening at a level near that of the roller and the transverse slot in the sleeve such that the bushing prevents oil pressure loss through the slot.

* * * * *